United States Patent [19]

Fee

[11] Patent Number: 4,953,787

[45] **Date of Patent: * Sep. 4, 1990**

[54] TWO PIECE RAIL FASTENING ASSEMBLIES FOR WOODEN CROSS TIES

[75] Inventor: Graham M. Fee, Geneva, Ohio

[73] Assignee: Chemetron-Railway Products, Inc., Wheeling, Ill.

[ * ] Notice: The portion of the term of this patent subsequent to Dec. 29, 2004 has been disclaimed.

[21] Appl. No.: 260,479

[22] Filed: Oct. 20, 1988

Related U.S. Application Data

[63] Continuation of Ser. No. 6/266,928, May 26, 1981, abandoned, which is a continuation-in-part of Ser. No. 6/240,411, Mar. 4, 1981, abandoned, and a continuation-in-part of Ser. No. 6/228,804, Jan. 27, 1981, Pat. No. 4,442,973, and a continuation-in-part of Ser. No. 6/262,710, May 11, 1981, Pat. No. 4,625,912, said Ser. No. 6/240,411, continuation of Ser. No. 6/930,232, said Ser. No. 6/228,804, continuation of Ser. No. 5/933/630, said Ser. No. 6/262,710, continuation of Ser. No. 6/57,823.

[51] Int. Cl.[5] ..... E01B 09/30

[52] U.S. Cl. ..... 238/349; 238/338

[58] Field of Search ..... 238/310, 315, 338, 343, 238/349, 355, 370, 371, 287, 297

[56] References Cited

FOREIGN PATENT DOCUMENTS

| | | | |
|---|---|---|---|
| 1253297 | 11/1967 | Austria | 238/349 |
| 7309640 | 1/1975 | Netherlands | 238/310 |
| 1154497 | 6/1969 | United Kingdom | 238/349 |
| 2034788 | 6/1980 | United Kingdom | 238/349 |

*Primary Examiner*—Andres Kashnikow
*Assistant Examiner*—Virna L. Mojica
*Attorney, Agent, or Firm*—Welsh & Katz

[57] ABSTRACT

A boltless two-piece rail fastening assembly for securing a railway rail, supported on a conventional tie plate, to a wooden cross tie is comprised of a chair and a rail clip latched thereon. The chair includes a body, having a jaw with a bight configured to receive the clip, and at least one downwardly projecting leg or shank for securing the chair adjacent the base flange of the rail. The rail clip is a torsional spring clip in the general form of an "S" having a rail-bearing leg for proximate engagement with the base flange of the rail and a tie bearing leg for proximate engagement with the tie plate.

6 Claims, 6 Drawing Sheets

TWO PIECE RAIL FASTENING ASSEMBLIES FOR WOODEN CROSS TIES

The present application is a continuation from copending application Ser. No. 266,928 filed May 26, 1981, now abandoned which is a continuation-in-part from applications Ser. No. 240,411 filed Mar. 4, 1981, now abandoned, which is a continuation from Ser. No. 930,232 filed Aug. 2, 1978, now abandoned; Ser. No. 228,804 filed Jan. 27, 1981, now U.S. Pat. No. 4,442,973, which is a continuation from Ser. No. 933,630 filed Aug. 14, 1978, now abandoned; and Ser No. 262,710 filed May 11, 1981, now U.S. Pat. No. 4,625,912 which is a continuation from Ser. No. 57,823 filed July 16, 1979, now abandoned, all of which are incorporated herein by reference.

BACKGROUND OF THE INVENTION

1. Field of the Invention

The present invention relates broadly to rail fastening assemblies incorporating a generally S-shaped rail fastening clip for securing a railway rail to a cross tie or similar rail support or sleeper. The present invention relates, more particularly, to an improved two-piece rail fastening assembly of this character specifically adapted for holding railway rails, supported on conventional tie plates, to wooden cross ties.

2. Description of the Art

A railway rail is typically secured to a wooden cross tie by supporting the rail on a tie plate and affixing the tie plate to the cross tie by means of large spikes. There are usually four spike holes provided on each of the field and gage sides of the tie plate, two holes fairly close to the position the rail base flange assumes on the tie plate and two near the outer edge of the tie plate. The heads of the spikes driven through the holes adjacent the base flange of the rail overlap the edges of the rail flange to hold it.

Rail anchors secured to the rail beneath the flange, on either side of the cross tie, usually complement the foregoing arrangement to prevent longitudinal motion or creeping of the rail. It is also conventional to use other assemblies in combination with this fastening arrangement to retard or prevent overturn motion of the rails during use. With little variation, this has been the scheme routinely employed for years to secure a railway rail to a wooden tie.

For purposes relevant to the present invention, a different type of assembly is proposed in British Pat. No. 1,154,497. This patent discloses a rail fastening assembly making use of a generally s-shaped rail clip in combination with a specially constructed tie plate. The tie plate is secured to the cross tie by means of a pair of fixture bolts or screws at the outboard sides only. A rib runs laterally across the tie plate adjacent the position of the base flange of the rail when the same is in place, and is provided with a projection designed to grasp or otherwise engage the central leg of the S-shaped clip. The clip is twisted, by use of a special tool designed to apply a torsional force to it, and is then positioned on the tie plate in this twisted configuration. One leg of the S clip engaqes the base flange of the rail while the opposite free end rests on the tie plate. The rail is thus restrained by virtue of the torsional force existing in the S-shaped clip. There are obvious drawbacks to each of the systems described above. With respect to the first-mentioned system of spikes, rail anchors, and rail-overturn prevention devices, considerable track maintenance and attendant expense are involved. Application of all these device is costly. There is a tendency for the different parts to loosen and move away from the tie due to the dynamic conditions encountered during use and cyclic expansion and contraction as the result of varying weather conditions. When rails require replacement the spikes must be removed and after awhile, the ties become "spike killed" and they too must be replaced The expense involved in maintaining a track which employs this type of hold-down assembly is considerable—having been reported to be as high as $15,000.00 per year per mile of track. There are also substantial disadvantages with respect to the second-mentioned, S-clip fastening assembly. Tie plates must be specially designed to receive the S-shaped rail clip. Special tools are required to stress the clip properly and to install it in that stressed condition. Obviously, this system is not well-adapted for use on existing tracks because of its very construction.

SUMMARY OF THE INVENTION

The present invention overcomes the disadvantages of the systems noted above. It may be used on both track installations and in rehabilitation of existing tracks. Its use minimizes the need for a bevy of rail anchors and rail-overturn prevention devices routinely employed in the complete package of hardware now used for securing rails on wooden cross ties, thus minimizing installation and maintenance expenses. No special tools are required to install the fastening assemblies of the present invention, either on new track or old. Yet, the advantages are achieved without a loss of holding power, or significant reduction in longitudinal and rotational or overture restraint of the rail.

Track held down by the assembly of the present invention may be replaced without pulling and redriving spikes, a practice which "spike kills" wooden ties necessitating eventual tie replacement since the spikes no longer hold properly in the wood. This is an especially important consideration for curves, where rails wear at about ten times the rate as straight track section.

These benefits are realized in one embodiment of the present invention, by employing a two-piece rail fastener comprised of a generally S-shaped rail clip received on the head of a mating chair designed to be anchored in the inboard spike hole of a conventional tie plate. Spikes in the outboard spike holes of the tie plate secure it to a wooden cross tie in the normal manner. The rail clip acts as a torsional spring clip to restrain the rail.

In another embodiment, at least one of the inboard spikes in the tie plate is replaced by a chair having downwardly depending shank. The shank passes through the spike hole in the tie plate and into tho tie where it is restrained or embedded. The S-shaped rail clip is received on the head of the chair to restrain the rail.

Other advantages of the present invention will become apparent to those skilled in the art upon examination of the following detailed description of preferred embodiment, taken in conjunction with the figures of drawing wherein:

DETAILED DESCRIPTION OF PREFERRED EMBODIMENTS

The following detailed description of preferred embodiments is made to illustrate the advantages of the present invention. This description is illustrative only, and should not be deemed to limit the scope of the instant invention as the same advantages may be realized even though variations on the preferred embodiments be made by those skilled in the art.

Figure 1:
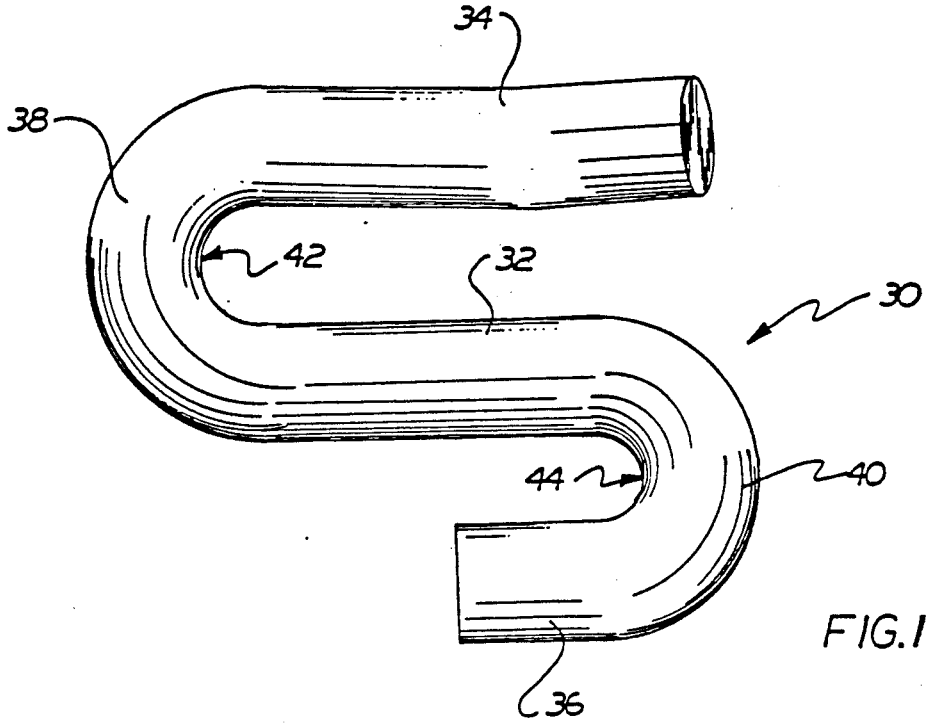
FIG. 1 is a top plan view of an S-shaped rail clip in accordance with the present invention, shown in its relaxed configuration.
Figure 2:
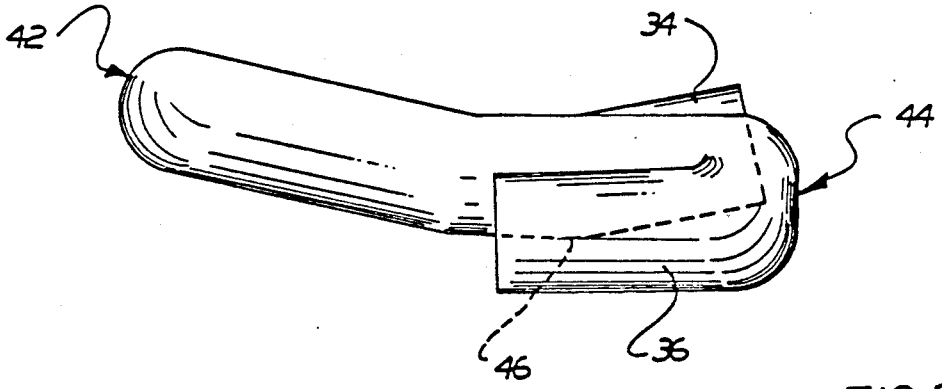
FIG. 2 is a side elevational view of the rail clip shown in FIG. 1.
Figure 3:
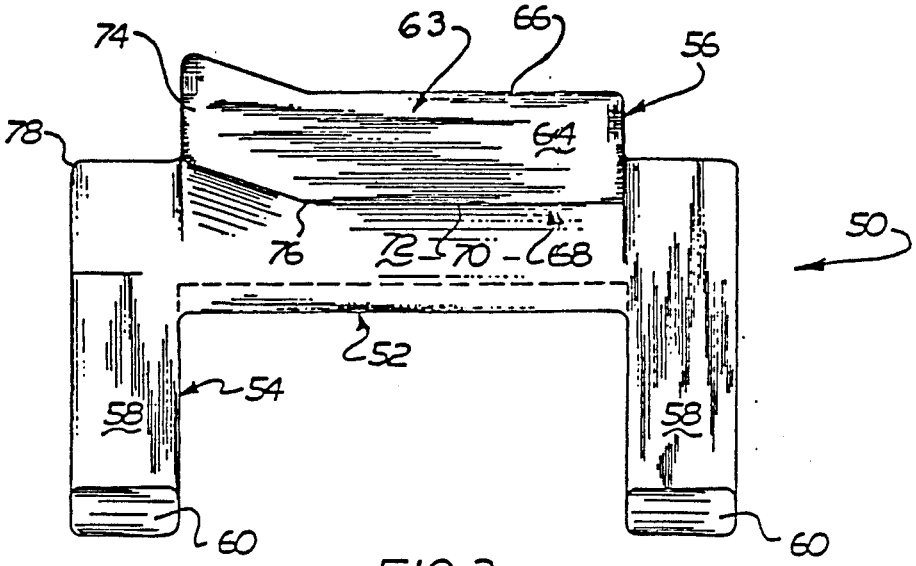
FIG. 3 is a side elevational view of one embodiment of a chair in accordance with the present invention.
Figure 4:
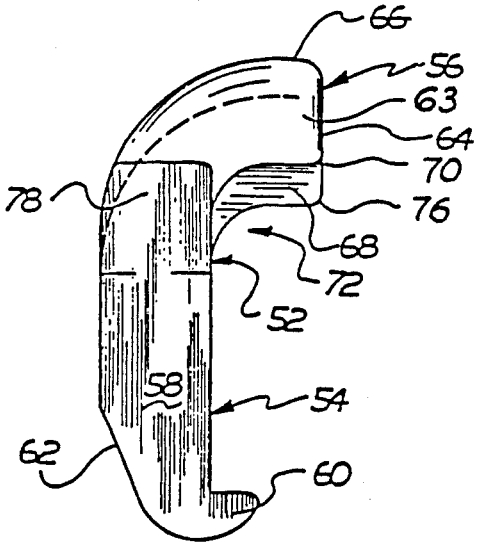
FIG. 4 is a front end view of the chair shown in FIG. 3.

One embodiment of a two-piece rail fastening assembly of the present invention designated generally as 10 and best viewed in FIGS. 5–8, is comprised of a generally S-shaped rail clip, designated generally as 30 and best viewed in FIGS. 1 and 2, and a chair designated generally as 50 and best viewed in FIGS. 3 and 4. The assembly 10 is specially adapted for use in combination with a standard tie plate 12 upon which a railway rail 14 is seated. The rail 14 as is conventional includes a stem 16 which terminates at its lower end in a base flange 18. The tie plate 12, supporting rail 14 is itself supported on a cross tie 20.

A standard tie plate is conventionally a steel plate extending beneath the entirety of the base flange 18 of rail 14 and projecting outwardly from the base area both the field and gage sides of the rail. Typically, the tie plate includes four holes pierced through the plate on each of the field and gage sides: a pair of outboard holes 22 and a pair of inboard holes 24. Although there may be some variations on this general arrangement of elements virtually all "conventional" tie plates follow this type of configuration. Note, for example, Vol. I, Manual for Railway Engineering (Fixed Properties) published by the American Railway Engineering Association, which provides specifications for tie plates. In the standard system for fastening a rail to a cross tie, headed lag bolts or spikes are used to secure the tie plate to the tie. The fasteners through the inboard holes 24 engage the base flange of the rail as well, so that the rail flange is sandwiched between the tie plate and the heads of the fastening bolts or spikes. In this manner, the rail is supported on and affixed to the tie plate which, in turn, is directly fastened to the cross tie.

Figure 7:
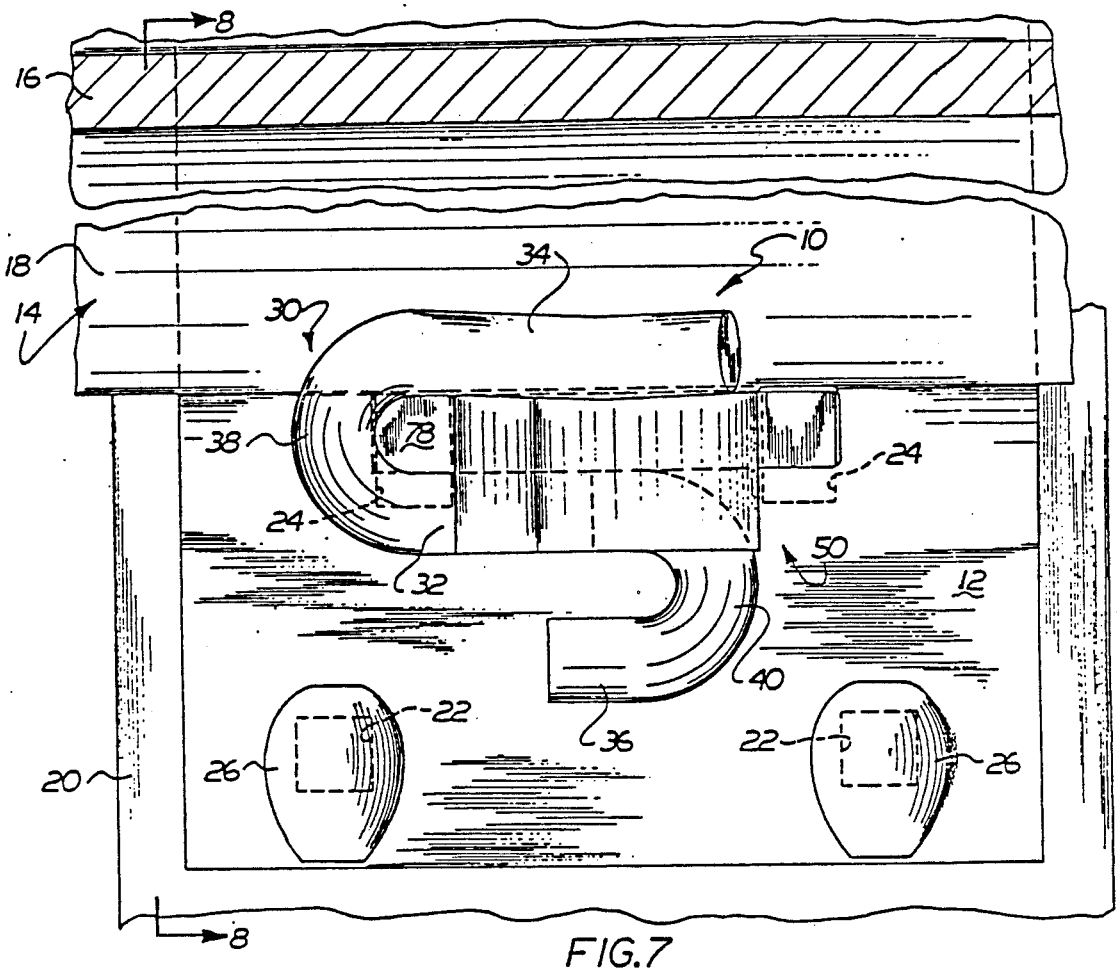
FIG. 7 is a top plan view of the assembly shown in FIG. 6.
Figure 8:
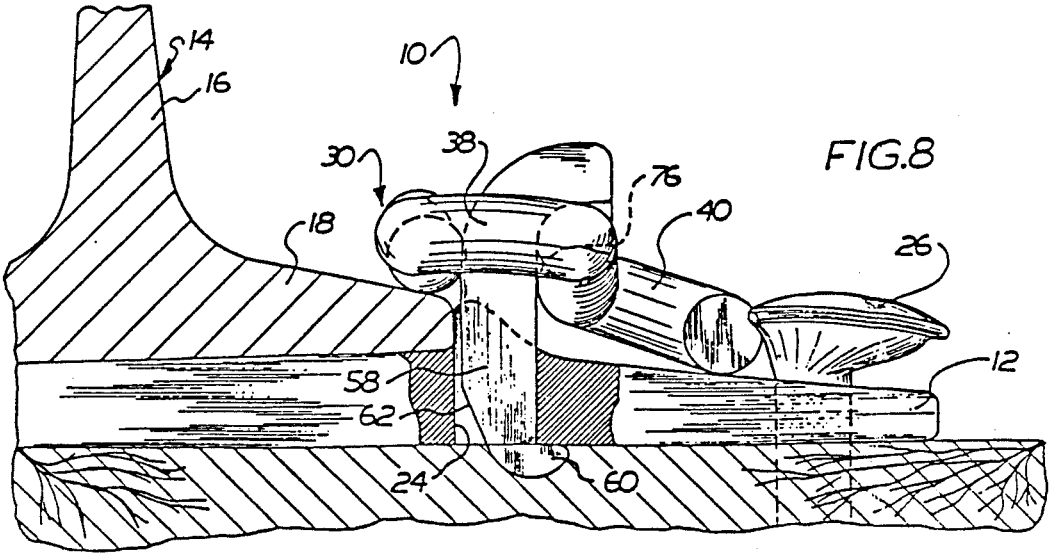
FIG. 8 is a view taken substantially along the line 8—8 of FIG. 7, with parts broken away to show the manner in which the chair is anChored on the tie plate.

As best viewed in FIGS. 7 and 8 one embodiment of the instant assembly 10 replaces both of the inboard bolts or spikes heretofore passing through inboard holes 24. As best viewed in FIGS. 11 and 12, another embodiment of the instant assembly 10 replaces only one of the inboard bolts spikes theretofore passing through an inboard hole 24. In both embodiments a pair of conventional headed lag bolts or spikes 26 are employed in the outboard holes 22 on each of the field and gage sides of the tie plate in order to secure the same to the cross tie 20. In the latter embodiment of FIG. 11 and 12, it is possible to employ this arrangement on light-rail tracks where the tie plate has only inboard holes since the chair itself can provide a means to stabilize the tie plate.

The rail clip component, 30, of the assembly 10 is a generally S-shaped torsional spring rail clip best viewed in FIGS. 1 and 2. Clip 30 is comprised of a central leg 32, a rail bearing leg 34 and a tie bearing leg 36. The rail bearing and tie bearing legs 34 and 36 are terminal legs of the clip 30, which are spaced on opposite sides of the central leg 32 and joined thereto by generally arcuate portions, 38 and 40 respectively, extending from opposite ends of central leg 32. With reference to FIG. 1, there are two loops thus defined on clip a first loop 42 comprised of central leg 32 rail bearing leg 34 and the arcuate portion 38 joining the two together, and a second loop 44 comprised of central leg 32 tie bearing leg 36, and the arcuate portion 40 joining the two together.

Loop 42 is bent slightly in an upward direction beginning at approximately the midpoint of central leg 32, as best viewed in FIG. 2. The angular displacement of loop 42 from the horizontal (with reference to FIG. 2) is preferably within the range of from about 15° to about 20°, and most preferably about 18°. The distal end of rail bearing leg 34 is also bent slightly in an upward direction. The angle of inclination of the distal end of leg 34 (with reference to FIG. 2) is preferably about 10° with respect to the horizontal. A land 46 is formed on the underside of leg 34 between the point at which loop 42 is bent upwardly and the point at which the distal end of the leg is bent upwardly.

In the embodiment shown in FIGS. 5–8, the chair 50 which cooperates with clip 30 is comprised of a body portion 52, an anchoring portion 54, and a head portion 56. The anchoring portion 54 depends downwardly from the body 52, and is comprised of a pair of legs 58 which terminate in hook or latch means 60. The spacing between legs 58 is substantially the same as the spacing between the inboard spike holes on a standard tie plate (e g., approximately 3 ½ inches on centers). Likewise, the cross-sectional dimensions and configurations of the legs 58 are designed to mate with the spike holes on a conventional tie plate, as is the projection of the hook or latch means 60. Insofar as there may be some variation in the shape and spacing of the inboard spike holes on various tie plates, the exact dimensions of the anchoring portion of chair 50 can be altered accordingly. To facilitate the insertion of the anchoring portion 54 of chair 50 within the inboard spike holes 24 on the tie plate, the lower ends of each of the legs 58 are provided with a slight inward taper 62, best viewed in FIGS. 4 and 8. Thus, this embodiment of chair 50 is secured to tie plate 12 by inserting the legs 58 through inboard holes 24 with the chair in a somewhat downwardly angled position, and thence rotating same to latch the hook 60 of each leg beneath the tie plate as shown in FIG. 8.

The head portion 56 of chair 50 is designed to cooperate in mating engagement with the rail clip 30. A lip 63 projects outwardly from the head portion 56 for this purpose, the lip 63 extending generally across the breadth of the body portion 52 between the legs 58. The lip 63 is defined by a front face 64, a top outside face 66, and a bottom inside face 68. The inside face 68 is slightly inwardly concave, tapering from an outer edge 70 and merging into the body portion 52. A jaw 72 is thus formed having a bight configured to receive the central leg of clip 30 as described more fully hereinbelow.

The lip 65 preferably includes an upwardly flared front end 74. The inside face 68 and, thus, jaw 72 follow the upward flare of lip 63 such that the bight of jaw 72 opens progressively as shown in FIGS. 3 and 4. The angle of inclination of the flare is approximately equal to, but preferably slightly less than, the angle of inclination of the loop 42 on clip 30 for reasons explained below A slight protuberance 76 is defined at the juncture of the flared and straight portions of the edge 70. This protuberance is designed to mate with a small notch or detent formed on the central leg 32 of clip 30 corresponding generally to the point at which the loop 42 is bent upwardly, as best viewed in FIG. 6. An overdrive preventer 78 is provided on the front end of body portion 52 by rounding the edges thereof in the area corresponding to the bight of jaw 72, as best viewed in FIGS. 3 and 7.

The assembly 10 comprised of the clip 30 and chair 50 illustrated in FIGS. 3 and 4 is best viewed in FIGS. 5–8. Installation of the assembly 10 is relatively simple, whether the fastening assembly is used on a new track installation or in the rehabilitation of old track The chair 50 is secured to the inboard spike holes 24 of tie plate 12 by canting the chair slightly and inserting the legs 58 through the inboard holes. The chair is then rotated upwardly so that the latch or hook member 60 projects beneath the tie plate 12, as shown in FIG. 8.

Figure 5:
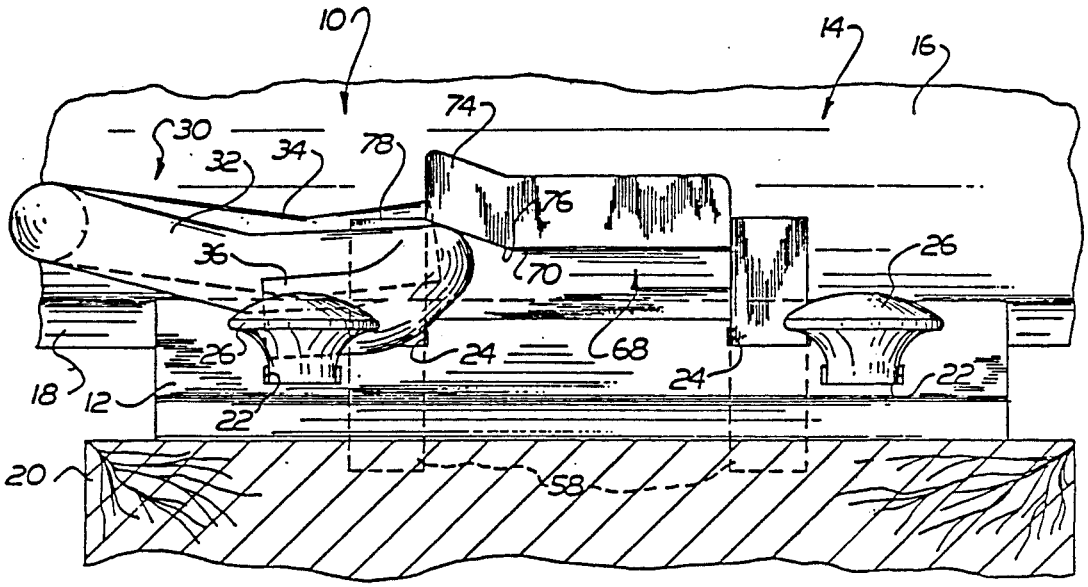
FIG. 5 is a side elevational view of one embodiment of an assembly in accordance with the present invention, where the rail clip is not fully seated.
Figure 6:
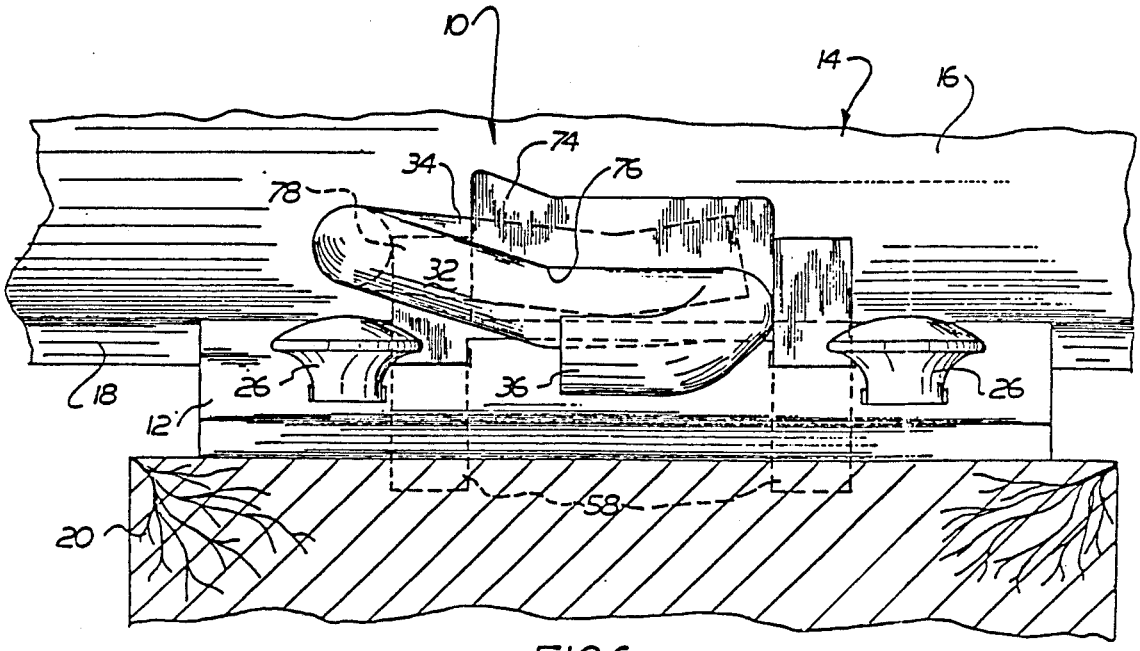
FIG. 6 is a view similar to FIG. 5, but showing the rail clip in a fully seated position and stressed configuration.

The S-clip 30 is driven into seating engagement with the chair 50. FIG. 5 shows the clip placed with the loop 40 in the flared portion of jaw 72 prior to the driving operation. The loop 42 is then struck with a hammer or equivalent tool and the clip is driven to the right into a fully seated position as shown in FIG. 6. During the driving operation, the tie bearing leg rides across the face of the tie plate 12 while the land 46 on the rail bearing leg rides across the face of the base flange 18 of rail 14. The flare of jaw 72 aids in guiding the central leg into latched, mating engagement with the head portion of the chair. When in the fully-seated position of FIG. 6, the slight protuberance 76 cooperates with the mating detent means on central leg 32 to insure a positive lock between the two components. Overdrive preventer 78 insures proper relative positioning of the protuberance/detent. Positive engagement of the clip with the chair is promoted by this protuberanace/detent arrangement, along with the relative angular relationship between the upwardly oriented loop on the clip and flared front end of the jaw on the chair and the relative dimensions between the spread of loop 42 and the thickness of the head portion of the chair on which this loop is received.

Upward forces are established in both of the terminal legs 34 and 36 when the clip 30 is seated. These forces arise, in part, because the top face of the flange 18 on the rail where leg 34 engages it is vertically displaced from the top face of tie plate 12 where leg 36 engages it, the amount of vertical displacement being greater than can be accommodated by the clip in its relaxed configuration. Consequently, the driving operation forces the legs 34 and 36 to be stressed upwardly when the clip is seated, the lip on the chair providing a downward restraining force on the central leg 32. This counteractive force provided by lip 63 also insures secure engagement of the hook means 60 with the tie plate 12. The upward forces in legs 34 and 36 are resolved through the two loops 42 and 44 as oppositely oriented rotational forces existing at opposing ends of central leg 32. Consequently, the clip 30 functions as a torsional spring rail clip where the holding power of the fastening assembly arises predominantly through torsion. The magnitude of the torsional force can be suitably tailored by appropriate selection of the angle of inclination of the loop 42 relative to the flare at the front of jaw 72 and the relative dimensioning of the legs of the clip. Furthermore, under dynamic operating conditions, the holding forces exerted against the rail will rise as the rail attempts to move away from the tie plate since the upward force on rail bearing leg 34 will increase and be resolved in central leg 32 as an increased torsional force.

An alternate embodiment of the assembly 10 is shown in FIGS. 9–12, wherein like reference numerals denote like parts in respect of the embodiment discussed above (FIGS. 1–8). The principal difference between the assembly shown in FIGS. 9–12 and that described above is that the chair 50 is secured directly to the wooden cross tie by means of a single leg or shank which passes through one of the inboard spike holes 24 only. Thus, in place of the two legs 58 of the chair described above, the alternate embodiment shown in FIGS. 9–12 has a single shank 80. Otherwise, the chair is identical to that described above and shown in the preceding figures of drawing.

Figure 9:
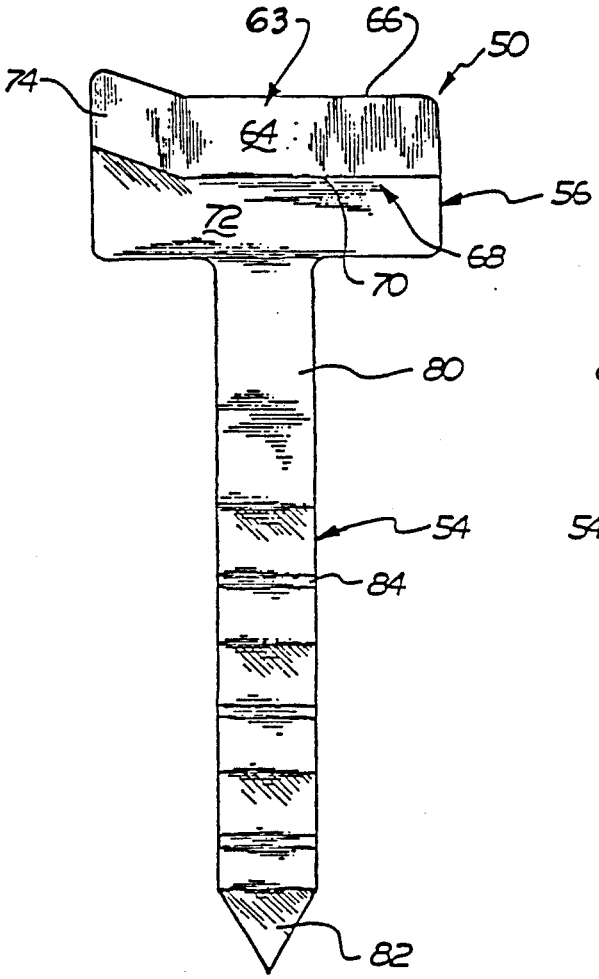
FIG. 9 and 10 are side elevational views of an alternate embodiment of a chair in accordance with the present invention.
Figure 10:
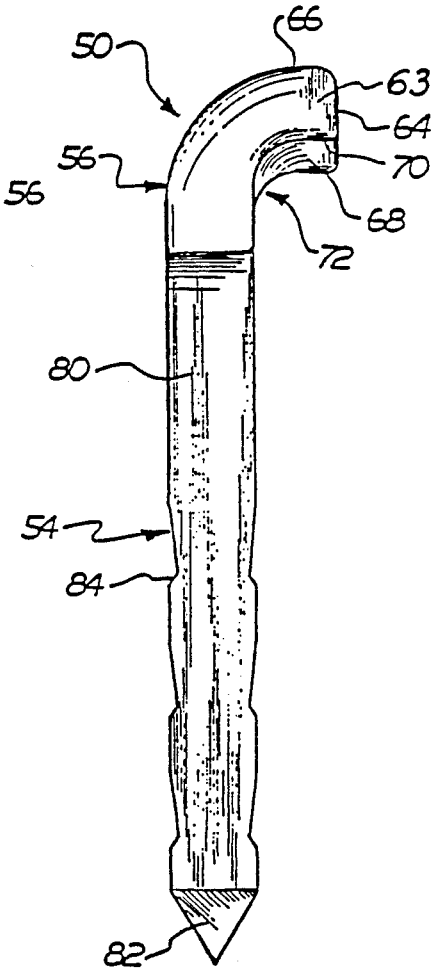

In the embodiment shown in FIGS. 9 and 10, the shank 80, which is preferably somewhat larger in cross section than a standard spike, terminates in a pointed tip 82 in order that the chair may be driven into this wooden member. The outer surface of the shank 80 is shown in FIGS. 9 and 10 to include a stepped wedge or barbed configuration of elements 84 to retard pullout of the chair from the wooden tie. Any similar surface roughening could equally well be employed for this purpose.

Figure 11:
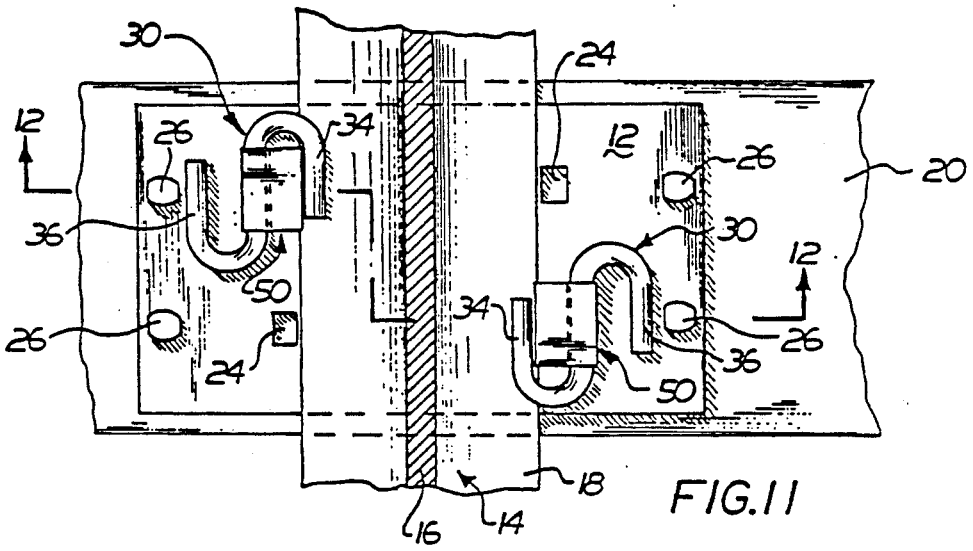
FIG. 11 is a top plan view of an alternate embodiment of an assembly of the present invention, and, FIG. 12 is a sectional view taken substantially along the line 12—12 of FIG. 11 showing various ways in which the chair may be restrained with the tie.
Figure 12:
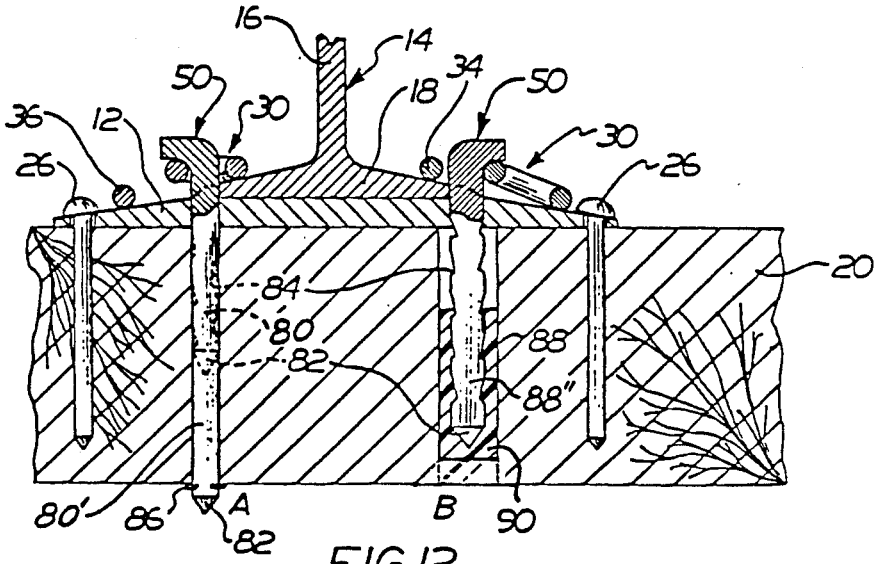

FIGS. 11 and 12 shown an assembly of the S-clip 30 and the alternate embodiment of the chair shown in FIGS. 9 and 10. FIG. 12 also shows a number of ways in which this chair may be restrained within the cross tie 20. For example, the chair shown at position A is illustrated, in full lines, with a smooth shank 80' terminating in a point 82, the length of the shank 80' being greater than the thickness of the tie 20. Restraining means 86 are included near the distal end of this shank to prevent pullout of the chair from the tie. Thus, this chair would be driven into position and, once the tip of shank 80' projected beyond the bottom surface of tie 20, the restraining means 86 would prevent upward motion of the chair. The embodiment illustrated in FIGS. 9 and 10 is shown in phantom lines at position A in FIG. 12 for comparison. This latter embodiment relies on the barbed or stepped surfaces at 84 to prevent pullout of the chair. In this case, where the tip of the chair does not include restraining means such as 86, a bonding agent may be applied to the outer surface of shank 80 to reduce further the tendency for pullout. Such a bonding agent could be, for example, magnesium phosphate cement.

Yet another means to secure the shank of a chair in tie 20 is shown at position B in FIG. 12. Here the tie 20 is provided with an oversized channel or cavity 88 filled with a bonding material 90. This bonding material could be magnesium phosphate cement, or a polymeric or resinous material compatible with the wooden tie. The bonding material 90 completely encapsulates a shank 80'' and, when rigid, indirectly bonds the shank of the chair to the wooden tie. The cross sectional area of cavity 88 is preferably larger than that of the spike hole through which shank 80'' projects. This serves two advantageous functions. First, when the bonding material 90 solidifies, pullout resistance is enhanced since the block of material holding the shank is larger than the spike hole. Thus, the shank must be parted from the bonding agent if it is to be removed. Second, the larger cross section of cavity 88, and the solid bonding material, improves lateral and longitudinal restraint of the chair relative to the rail. Depending on design considerations, the filled cavity 88 need not extend entirely through the tie 20. This approach is shown in full lines in FIG. 12 at position B. If desired, the cavity can go through the tie, as shown in phantom lines in FIG. 12 at position B. Either approach may also be advantageous for securing the chair in a spike-killed tie. Other conceptually similar approaches may be used to guard against pullout of the chair without departing from the spirit of the present invention.

Since the chair of the alternate embodiment shown in FIGS. 9–12 replaces but a single inboard spike, it is preferable to stagger the placement of the chairs on field and gage sides the rail, as shown in FIG. 11. Depending on the configuration of the shank 80, this will minimize any tendency for splitting the wooden cross tie 20. Also, a more uniform holding force is applied across the rail 14 in this staggered configuration. Because the chair in this alternate embodiment is directly affixed to the tie, as opposed to indirect affixation in the embodiment of FIGS. 3 and 4, it may be advisable in the scheme shown in FIGS. 11 and 12 to provide the undersurface of tie plate 12 with a coating of a bonding material such as those described above. This bonding material will tend to prevent relative movement between the tie and the tie plate which could, under severe conditions, loosen the shank 80 in its grip on the tie depending, for example, on which of the many shank configurations is used.

Fabrication of the components of assembly 10 is very easy. The clip 30 is preferably fashioned from round stock of spring steel having an appropriate diameter and length suitable to yield one clip. The spring is fashioned by bending the presized rod around mandrels and the required angularity of the loops is imparted by a simple forming operation. The spring clip can then be heat treated in a conventional manner to give requisite strength and ductility thereto. The chair 50 may be cast from ductile iron, or formed from steel and appropriately heat treated.

The operation of assembly 10 of the present invention is extremely efficient. When pairs of assembly 10 are used, one on each of the field and gage side, to hold a length of track in place, the holding power of the assembly in both longitudinal and rocking or overturn directions is sufficient to reduce the need for both rail anchors and conventional overturn preventers in many applications, and even to eliminate the need for such devices in other applications. This allows for considerable savings in both the capital expense of installing or rehabilitating a rail and also the maintenance involved in re-application of rail anchors and overturn preventers since the same have a tendency to loosen over a period of time. Furthermore, rails can be replaced by simply removing the spring clip. Since no spikes need be removed, tie life is prolonged considerably.

Having now described the present invention with reference to certain preferred embodiments thereof, the skilled artisan will recognize that various substitutions, modifications, changes, and omissions may be made without departing from the spirit thereof. For example, changes in the dimension, numbers or location of spike holes in the tie plate are intended within the disclosure of the present invention. Likewise, a compression of the geometry of the S clip (e.g., squashing as viewed in plan) while retaining the torsional force for holding power is intended within the disclosure of the present invention. In like vein, the chair of the embodiment shown in FIGS. 9–12 could be formed with two shanks, spaced and dimensioned to pass through both inboard holes in the tie plate into engagement with the tie. Accordingly, it is intended that the present invention be limited solely by the scope of the following claims.

What is claimed is:

1. A boltless two-piece rail fastening assembly for fastening a railway rail supported on a conventional tie plate to a wooden cross tie, comprising:

(a) an S-shaped rail clip having a singular central leg, and a rail bearing leg and a tie bearing leg spaced on opposite sides of said central leg and joined thereto by arcuate portions extending form opposite ends thereof, said clip further having latching means including a detent on said central leg; and (b) a chair having a body including jaw means defining a lip for receiving said clip in latching engagement therewith, latching means on said body including a mating protuberance on the lip of said chair for securing said clip on said chair when the former is driven into engagement with the latter, and anchor means for securing said body proximate the base flange of a railway rail supported on the tie plate, said anchor means including at least one downwardly depending leg configured to pass through a spike hole in a conventional tie plate affixed to a wooden tie.

2. A rail fastening assembly as defined in claim 1 wherein said anchor means comprises a pair of anchor legs spaced from one another a distance substantially equal to the spacing of a pair of spike holes in said tie plate adjacent the base flange of a railway rail to be fastened to said wooden tie.

3. A rail fastening assembly as defined in claim 2 wherein each of said anchor legs includes a hook element for projecting beneath and releasably engaging said tie plate so as to secure said body to said tie plate.

4. A rail fastening assembly as defined in claim 3, wherein each of said hook elements has an outwardly projecting hook for engagement with the bottom surface of said tie plate so as to prevent upward lifting of said body from said tie plate.

5. A boltless two-piece rail fastening assembly for fastening a railway rail supported on a conventional tie plate to a wooden cross tie, comprising:

(a) an S-shaped rail clip having a singular central leg, and a rail bearing leg and a tie bearing leg spaced on opposite sides of said central leg and joined thereto by arcuate portions extending from opposite ends thereof; and (b) a chair having a body including jaw means for receiving said clip in latching engagement therewith, said jaw means including a lip projecting outwardly from said body and flared upwardly at a front end thereof, said jaw means having a concave face defining a bight configured to receive at least a portion of said central leg of said rail clip, the flare in said lip terminating at a slight protuberance at the upper edge of said bight, said protuberance comprising latching means for cooperation with a matching detent on said clip, and anchor means for securing said body to said tie plate proximate the base flange of a railway rail supported on said tie plate, said anchor means including at least one downwardly depending leg configured to pass through a spike hole in the tie plate when affixed to a wooden tie.

6. A rail fastening assembly as defined in claim 5 wherein said bight opens in a direction facing away from said rail.

* * * * *

UNITED STATES PATENT AND TRADEMARK OFFICE

CERTIFICATE OF CORRECTION

PATENT NO. : 4,953,787

DATED : Sept. 4, 1990

INVENTOR(S) : Graham M. Fee

It is certified that error appears in the above-identified patent and that said Letters Patent is hereby corrected as shown below:

Column 1, line 66, "There are..." should begin a new paragraph.

Column 2, line 3, "device" should be --devices--.

Column 2, line 9, insert a period (.) after "replaced".

Column 2, line 24, after "both" insert --new--.

Column 2, line 35, "overture" should be --overturn--.

Column 2, line 42, "section" should be --sections--.

Column 2, line 47, "hole" should be --holes--.

Column 2, line 55, "tho" should be --the--.

Column 3, line 17, "anChored" should be --anchored--.

Column 3, line 44, insert a coma (,) after "14" and after "conventional".

Column 3, line 46, insert a coma (,) after "14".

Column 3, line 51, before "both" insert --on--.

Column 4, line 6, "theretofore" should be --heretofore--.

Column 4, line 24, after "clip" insert --30;--.

Column 4, line 25, insert a coma (,) after "32".

UNITED STATES PATENT AND TRADEMARK OFFICE

CERTIFICATE OF CORRECTION

PATENT NO. : 4,953,787

DATED : Sept. 4, 1990

INVENTOR(S) : Graham M. Fee

It is certified that error appears in the above-identified patent and that said Letters Patent is hereby corrected as shown below:

Column 4, line 27, insert a coma (,) after "32".

Column 5, line 10, "65" should be --63--.

Column 5, line 17, insert a period (.) after "below".

Column 5, line 31, insert a period (.) after "track".

Column 7, line 30, the word --of-- should follow "sides".

Signed and Sealed this

Twelfth Day of May, 1992

*Attest:*

DOUGLAS B. COMER

*Attesting Officer*

*Acting Commissioner of Patents and Trademarks*